United States Patent [19]

Meyers

[11] 4,213,559

[45] Jul. 22, 1980

[54] DIVIDED DISPLAY CARTON

[75] Inventor: George L. Meyers, Menasha, Wis.

[73] Assignee: American Can Company, Greenwich, Conn.

[21] Appl. No.: 893,787

[22] Filed: Apr. 5, 1978

[51] Int. Cl.[2] ..... B65D 5/48

[52] U.S. Cl. ..... 229/16 D; 229/27; 229/30; 229/15; 229/DIG. 9; 206/806

[58] Field of Search ..... 229/27, 30, 15, 31 FS, 229/DIG. 9, 35.16 D; 206/806

[56] References Cited

U.S. PATENT DOCUMENTS

| | | | |
|---|---|---|---|
| 1,898,231 | 2/1933 | Weiss | 229/27 |
| 2,529,725 | 11/1950 | Currie | 229/DIG. 9 |
| 2,675,956 | 4/1954 | Currie | 229/DIG. 9 |
| 2,710,131 | 6/1955 | Geller | 229/15 |
| 2,774,468 | 12/1956 | Rous | 229/27 |
| 2,983,421 | 5/1961 | Turpin | 229/27 X |
| 3,227,266 | 1/1966 | Soma | 229/27 |
| 3,356,281 | 12/1967 | Buttery | 229/27 |
| 3,554,402 | 1/1971 | Lock | 229/27 X |
| 3,682,297 | 8/1972 | Austin et al. | 229/27 X |
| 3,829,003 | 8/1974 | Dilot | 229/15 |
| 4,106,615 | 8/1978 | Hiroshi | 206/806 X |

*Primary Examiner*—Moy Joseph M.
*Attorney, Agent, or Firm*—Robert P. Auber; Ira S. Dorman; Harry C. Engstrom

[57] ABSTRACT

A divided display carton is disclosed which is designed to hang suspended from a pair of hooks, pegs, or similar devices, and which is divided into two display compartments. The display partition includes a partition bottom flap designed to be glued into the bottom structure of the carton so that the carton is rigid and durable. The blank for the carton is designed so that successive blanks cut from a continuous piece of stock material can be nested into each other to save stock material.

9 Claims, 5 Drawing Figures

DIVIDED DISPLAY CARTON

BACKGROUND OF THE INVENTION

1. Field of the Invention

The present invention relates to display cartons in general, and in particular, to display cartons designed to depend from hooks, pegs, or other hanging devices and which are divided into compartments to separate the articles to be sold.

2. Description of the Prior Art

The prior art is generally cognizant of divided display cartons which are designed to depend from hooks or other hanging devices and which include means to divide the carton into two or more compartments for the display of articles. It has been a problem with such cartons, however, that they are insufficiently rigid. It has also been a problem with such cartons that the blanks for these cartons are relatively inefficient in their utilization of paperboard stock material.

SUMMARY OF THE INVENTION

The present invention is summarized in that a divided display carton includes a generally rectangular back panel, a pair of side panels extending forwardly in parallel from the opposite side edges of the back panel, a front panel extending between the side panels, a side bottom flap depending from each of the side panels, both side bottom flaps being inwardly folded to be generally perpendicular to the side panels, a bottom panel depending from the bottom edge of the front panel and inwardly folded to be perpendicular to said front panel, the bottom panel being securely fixed to the side bottom flaps, a partition panel extending between the back panel and the front panel, and a partition bottom flap depending from the partition panel and securely fixed between the bottom panel and one of the side bottom flaps.

It is an object of the present invention to construct a divided display carton that is very rigid and durable when erected.

It is another object of the present invention to provide a blank for such a divided display carton that is optimally efficient in its utilization of paperboard stock material.

It is yet another object of the present invention to construct such a divided display carton in a more economical and efficient manner than was heretofore possible.

Other objects, advantages, and features of the present invention will become apparent from the following specification when taken in conjunction with the accompanying drawings.

DESCRIPTION OF THE PREFERRED EMBODIMENT

Figure 1:
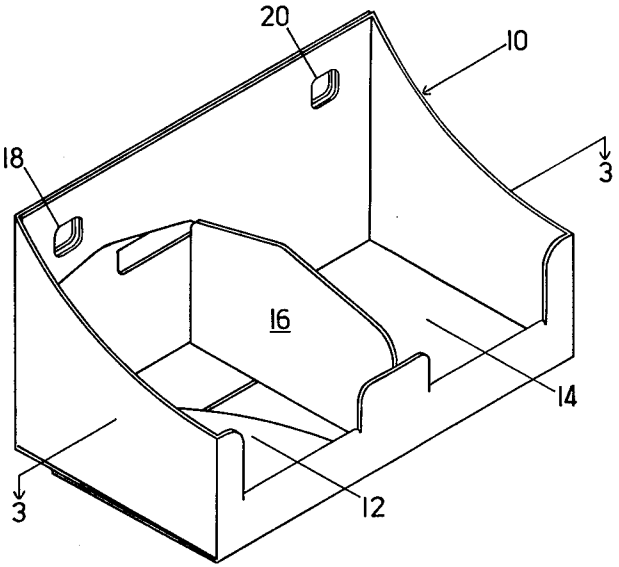
FIG. 1 is a perspective view of a divided display carton constructed according to the present invention.

Shown in FIG. 1 is a divided display carton, generally indicated at 10, constructed according to the present invention. The divided display carton 10 includes two compartments, 12 and 14, for receiving therein a variety of goods to be displayed for sale. The two compartments 12 and 14 are divided by a partition panel 16 so that goods within the two compartments 12 and 14 may be segregated from each other. A pair of holes 18 and 20 are provided in the back of the display carton 10 so that the display carton 10 may be hung from appropriate hooks or pegs, such as on a pegboard display or other similar mounting.

Figure 2:
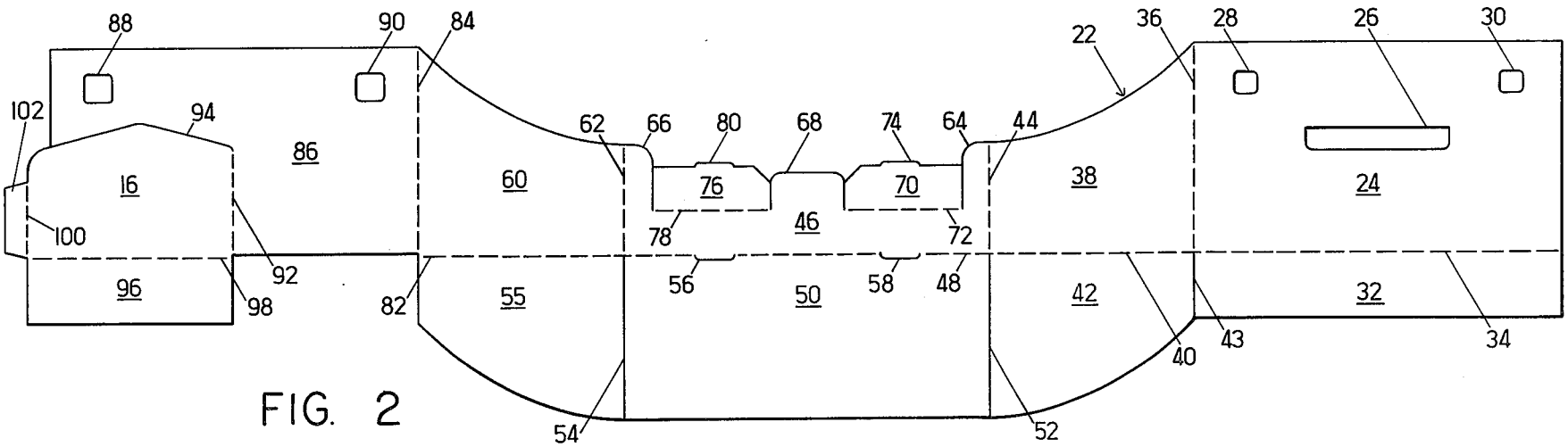
FIG. 2 is a plan elevation view of a carton blank from which the divided display carton of FIG. 1 may be constructed.

The divided display carton 10 of FIG. 1 is constructed from a divided display carton blank, generally indicated at 22 and shown in FIG. 2 from its interior side. The blank 22 includes, beginning at the right in FIG. 2, a carton back panel 24 of a generally rectangular shape. Formed within the back panel 24, which has its longer axis in a generally horizontal direction, is an elongated rectangular cutout 26 centrally formed within the back panel 24. Also formed within the back panel 24, adjacent both of the upper extreme corners thereof, are a pair of hole cutouts 28 and 30, each of a generally square shape. Attached to the lower longer side of the back panel 24 is a relatively narrow, rectangular, back bottom flap 32 attached to the back panel 24 by a scoreline 34. Secured to the left-hand shorter side of the back panel 24 by a scoreline 36 is a side panel 38. The side panel 38 has linear side and bottom edges, but has a tapered, curved, top edge, which is intended to form one of the top side edges of the finished display carton 10. Attached to the bottom of the side panel 38 by a scoreline 40 is a side bottom flap 42. The side bottom flap 42 is separated from the back bottom flap 32 by a linear die-cut 43. The side bottom flap 42 also has three linear side edges with its bottom edge being of a curved nature complementary to the curve of the top edge of the side panel 38.

Attached to the shorter side of the side panel 38 by a scoreline 44, which is on the opposite side of the side panel 38 from the scoreline 36, is a front panel 46. The front panel 46 has formed along its lower edge a scoreline 48 attaching it to a bottom panel 50 of a generally rectangular shape. The scoreline 48 is a colinear with the scorelines 40 and 34. The bottom panel 50 has its two shorter sides defined by die-cuts 52 and 54 to separate the bottom panel 50 from the side flap 42 and another side bottom flap 55. Formed adjacent the scoreline 48 between the front panel 46 and the bottom panel 50 are a pair of die-cuts 56 and 58. Attached to the end of the front panel 46 opposite from a side panel 38 is a side panel 60, which is a mirror image of the side panel 38, and which is attached to the front panel 48 by a scoreline 62. Adjacent the respective scorelines 44 and 62, the front panel 46 has formed in it a pair of respective retaining display edgings 64 and 66. In its center the front panel 46 has formed an upwardly extending partition reinforcing tab 68. Between the display edging 64 and the reinforcing tab 68 in the front panel 46 is formed a reinforcing flap 70 joined to the front panel 46 by a scoreline 72, and having formed at its top edge a locking tab 74. Similarly, formed between the display edging 66 and the reinforcing tab 68 is another reinforcing flap 76 joined to the front panel 46 by a scoreline 78 and having formed at its upward edge a locking tab 80.

The side panel 60 is joined to the side bottom flap 55 by a scoreline 82 also colinear with the scorelines 48, 40 and 34. Similarly to the side panel 38 and the side bottom flap 42, the curves of the top edge of the side panel 60 and the bottom edge of the side bottom flap 55 are complementary. Attached to the left-hand edge of the side panel 60, by a scoreline 84, is a reinforcing back panel 86. The reinforcing back panel 86 has formed within it, adjacent its upper extreme corners, a pair of hole cutouts 88 and 90. The hole cutouts 88 and 90 are formed of a generally square shape. A vertically extending scoreline 92 is formed within the center of the reinforcing back panel 86 to attach the reinforcing back panel 86 to the partition panel 16. The top edge of the partition panel 16 is separated from the reinforcing back panel 86 by a die-cut 94. Attached to the partition panel 16 along its bottom edge is a partition bottom flap 96, joined to the partition panel 16 by a scoreline 98. The partition bottom flap 96 is a generally rectangular flap having one of its longer sides along the edge defined by the scoreline 98. The extreme end of the partition panel 16 opposite from the scoreline 92 is defined by a scoreline 100 which attaches a gluing tab 102 to the partition panel 16.

In the erection of the divided display carton 10 of FIG. 1 from the divided display carton blank 22 of FIG. 2, the side panels 38 and 60 are first folded along the scorelines 44 and 46 to be perpendicular to the front panel 46. Viewing the side of the blank 22 as shown in FIG. 2, these folds would be toward the observer. After the side panels 38 and 60 are perpendicular to the front panel 46, the back panels 24 and 86 are then folded inwardly along the scorelines 36 and 84 to be perpendicular to the respective side panels 38 and 60 and parallel to the front panel 46. The reinforcing back panel 86 is disposed inside of the back panel 24 and is securely glued thereto. The partition panel 16 may then be folded along its scoreline 92 to be perpendicular to the composite back panel and extending toward the front panel 46. The gluing tab 102 is folded along the scoreline 100 to be perpendicular to the partition panel 16 and is glued to the back of the front panel 46 in the area of the reinforcing tab 68 as is shown in FIG. 3.

To form the bottom of the divided display carton 10, the side bottom flaps 42 and 55 are first folded inwardly along the respective scorelines 40 and 82 to be perpendicular to the respective side panels 38 and 60. With the side bottom flaps 42 and 55 in their proper positions, the partition bottom flap 96 may be folded to be perpendicular to the partition panel 16 and parallel to the side bottom flaps 42 and 55, the partition bottom panel 96 being received underneath the side bottom flap 55. The back bottom flap 32 may then be folded inwardly to be perpendicular to the back of the carton 10, and then the bottom panel 50 is folded inwardly to be perpendicular to the front panel 46 and is securely fixed to the other elements of the bottom of the container. Suitable adhesive glue or other fastening means may be used to securely fix the bottom panel 50 to the side bottom flaps 42 and 55, the partition bottom flap 96 and the back bottom flap 32 to form a secure and rigid bottom for the carton 10. To finish the front of the display carton 10, the reinforcing flaps 70 and 76 are folded into the interior of the carton 10 and downwardly until the locking tabs 74 and 76 are received within the recesses formed by the respective die-cuts 58 and 56. This completes the divided display carton 10 as shown in FIG. 1.

Figure 3:
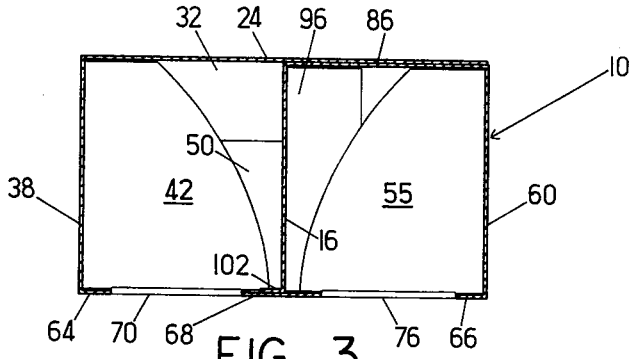
FIG. 3 is a cross-sectional view taken along the line 3—3 in FIG. 1.

As is shown by the cross-sectional view of FIG. 3, the erected divided display carton 10 has a particularly rigid and strong bottom structure. Since the partition bottom flap 96 is fixedly glued in place between the side bottom flap 55 and the bottom panel 50, any movement of the partition panel 16 relative to the elements of the rest of the carton 10 is prevented. In addition, each of the elements of the bottom of the carton 10, including the side bottom flaps 42 and 55 and the bottom panel 50, are all secured to the back bottom flap 32 to further make rigid the bottom of the carton 10.

The divided display carton 10 of FIG. 1 is used for the merchandising display of a variety of articles each received within the compartments 12 and 14. The hole cutouts 28 and 30 and 88 and 90 in the back panels 24 and 86 are overlayed when the back panels 24 and 86 are adhered to each other thereby forming the holes 18 and 20 in the finished carton 10. The holes 18 and 20 are provided so that the carton 10 may be suspended from suitable hooks, pegs or similar devices in a hanging display. The carton 10 is particularly suitable for relatively heavy loads because of the double thickness of the stock material surrounding the respective holes 18 and 20. The rectangular cutout 26 formed in the rearmost back panel 24 is provided so that a vertical knife-edge type hanging device may be inserted between the back panels 24 and 86 as an alternate method of suspending the display carton 10.

Figure 4:
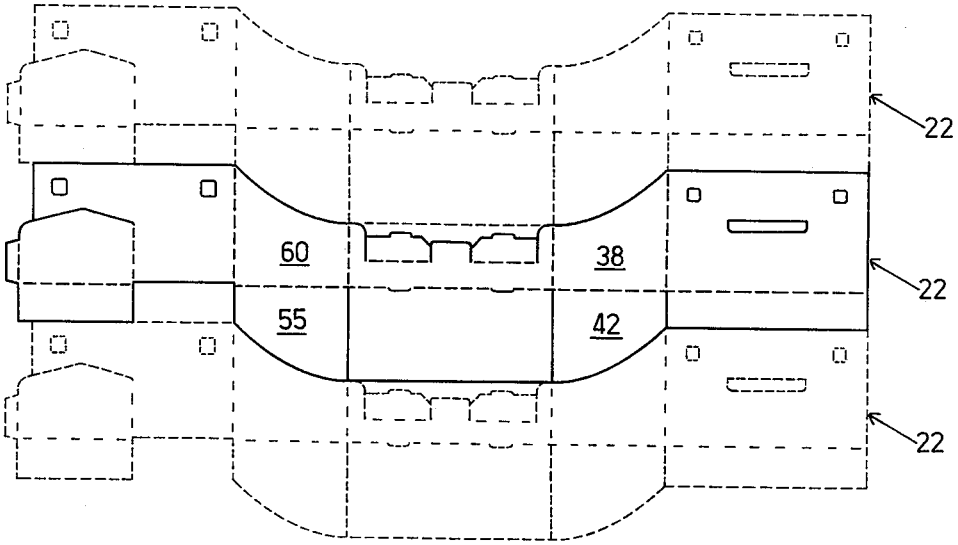
FIG. 4 is a schematic plan view of several nested blanks similar to that of FIG. 2.

Another particularly advantageous feature of the blank 22 for use in making the display carton 10, is that successive ones of the blank 22 as they are being cut from a single piece of stock paperboard material may be nested within each other so as to conserve paperboard. This feature, which is illustrated in FIG. 4, arises in part from the complementary curved surfaces which form the upper edges of the respective side panels 38 and 60 and the lower edges of the respective side bottom flaps 42 and 55. As can be seen in FIG. 4, these edges adjoin the respective complementary edges in successive ones of the blanks 22 when the blanks are being cut from a sheet of stock material, thereby allowing adjacent blanks to be nested without the wasting of intervening stock material. Therefore, if a sheet of stock material from which the blanks 22 are to be cut is sized to be in width approximately the width of a single blank 22, very little paperboard material is wasted, and a significant economic advantage is achieved through the use of the blank 22.

Figure 5:
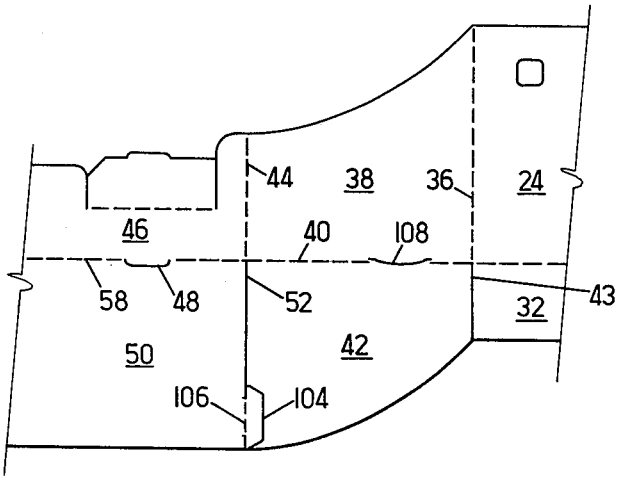
FIG. 5 is a plan view of a portion of an alternative embodiment of the blank of FIG. 2.

Shown in FIG. 5 is a segment of an alternative embodiment of the blank 22 for constructing the divided display carton 10. The blank of FIG. 5 has provided within it extending from each side of the bottom panel 50 a locking tab 104 attached to the respective side of the bottom panel 50 by a scoreline 106. A die-cut 108 is formed along the lower edge of the side panel 38 adjacent to the scoreline 40. A similar locking tab 104 is provided on the opposite edge of the bottom panel 50 (not shown) and a similar die-cut 108 is provided in the side panel 60 (not shown). The blank of FIG. 5 is assembled similarly to the blank 22 of FIG. 2, with the exception that the locking tabs 104 are both folded upward perpendicularly to the bottom panel 50 along the scorelines 106 and are inserted into the die-cuts 108 as the bottom panel 50 is folded upward to close the bottom of the carton 10. The locking of the locking tabs 104 serve to secure the bottom of the carton 10 in place while adhesive sets, or may be used without adhesive if a rigid bottom for the carton 10 is not desired.

It is understood that the present invention is not limited to the particular construction and arrangement of parts disclosed and illustrated herein, but embraces all such modified forms thereof as come within the scope of the following claims. Although in the illustrated embodiments the top edge of the side panel is shown to be curved, it should be appreciated that other configurations such as rectilinear, may also be employed. While the bottom edge of the side bottom flap will generally complement the configuration of the top edge of the side panel to maximize efficiency of material utilization that need not necessarily be the case.

I claim:

1. An open-topped divided display carton comprising:

a. a generally rectangular back panel having a pair of hole cutouts formed therein;

b. a reinforcing back panel having a pair of hole cutouts formed therein and adhered to the back panel so that the respective hole cutouts are aligned so that the carton may be suspended therefrom;

c. a pair of side panels each extending forwardly in parallel from the opposite side edges of the back panel, a one of the side panels attached to the back panel and the other of the side panels attached to the reinforcing back panel;

d. a front panel extending between the side panels;

e. a side bottom flap depending from each of the side panels, both side bottom flaps being inwardly folded to be generally perpendicular to the side panels;

f. a bottom panel depending from the front panel and inwardly folded to be generally perpendicular to the front panel, the bottom panel being securely fixed to both of the side bottom flaps;

g. a partition panel extending between the back panel and the front panel, the partition panel being a cutout portion of the reinforcing back panel; and h. a partition bottom flap depending from the partition panel and extending between the bottom panel and one of the side bottom flaps, the partition bottom flap being glued securely to both the bottom panel and the side bottom flap to make the carton rigid and to fix the partition rigidly in position.

2. A divided display carton as claimed in claim 1 wherein a back bottom flap is provided depending from the back panel, the back bottom flap being folded inwardly perpendicular to the back panel and being fixed securely between the bottom panel and the side bottom flaps.

3. A divided display carton as claimed in claim 1 wherein the partition panel includes a gluing tab secured to the interior of the front panel.

4. A divided display carton as claimed in claim 1 wherein each of the side panels has a curved upper edge and wherein each of the side bottom flaps has a curved lower edge, the curved edges of the top edge of the side panel and the bottom edge of the side bottom flaps being complementary in shape.

5. A blank for an open-topped divided display carton comprising:

a. an elongated front panel having a long bottom edge and two shorter edges;

b. a generally rectangular bottom panel attached to the bottom edge of the front panel;

c. a side panel attached to each side edge of the front panel;

d. a side bottom flap attached to the bottom edge of each side panel;

e. a back panel attached to the side of a one of the side panels opposite the front panel, the back panel having a pair of hole cutouts formed therein and being wider than the front panel;

f. a reinforcing back panel attached to the other of the side panels opposite the front panel, the reinforcing back panel also having a pair of hole cutouts formed and adapted to being adhered to the back panel so that the respective hole cutouts are aligned so that the carton may be suspended therefrom;

g. the side panels each having a curved upper edge extending from the respective one of the back panel and the reinforcing back panel to the front panel, and the side bottom flap having a curved lower edge, the curve of the bottom edge of the side bottom flap being complementary to the curve of the top edge of the side panel so these edges on adjacent blanks interfit to conserve stock material;

h. a partition panel formed as a cut-out portion of the reinforcing back panel, the partition panel being adapted to be folded to extend from the reinforcing back panel to the front panel; and i. a partition bottom flap depending from the partition panel and secured to the bottom panel.

6. A blank for a divided display carton as claimed in claim 5 wherein a pair of reinforcing flaps are formed in the front panel.

7. A blank for a divided display carton as claimed in claim 6 wherein a locking tab is formed on each of the reinforcing flaps and the front panel has die-cuts formed in it adjacent its lower edge and adapted to receive the locking tabs on the reinforcing flaps.

8. A blank for a divided display carton as claimed in claim 12 wherein one of the back panels has an elongated rectangular cut-out formed therein.

9. A blank for a divided display carton comprising:

a. an elongated front panel having a long bottom edge and two shorter edges;

b. a generally rectangular bottom panel attached to the bottom edge of the front panel;

c. a side panel attached to each side edge of the front panel;

d. a side bottom flap attached to the bottom edge of each side panel;

e. a back panel attached to the side of each side panel opposite the front panel, the back panels being wider than the front panel;

f. the side panels each having a curved upper edge extending from the respective back panel to the front panel, and the side bottom flap having a curved lower edge, and the curve of the bottom edge of the side bottom flap being complementary to the curve of the top edge of the side panel so these edges on adjacent blanks interfit to conserve stock material; and g. a locking tab formed on each of the opposite side edges of the bottom panel; and h. each of the side panels having formed in it a die-cut adapted to receive a respective locking tab on the bottom panel.

* * * * *